US006459876B1

(12) United States Patent
Buchanan et al.

(10) Patent No.: US 6,459,876 B1
(45) Date of Patent: Oct. 1, 2002

(54) TONER CARTRIDGE

(75) Inventors: John Andrew Buchanan; Chris Anthony Burdette; Philip Scot Carter; John William Kietzman; Benjamin Keith Newman; Matthew Lee Rogers, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/908,245

(22) Filed: Jul. 18, 2001

(51) Int. Cl.[7] ..... G03G 15/08

(52) U.S. Cl. ..... 399/254; 366/309; 366/311; 399/263

(58) Field of Search ..... 399/263, 254, 399/256; 366/154.1, 156.1, 157.1, 157.2, 309, 342, 343, 155.1, 158.1, 311, 312, 313

(56) References Cited

U.S. PATENT DOCUMENTS 25,329 A * 9/1859 Haeckel ..... 366/343
3,410,533 A * 11/1968 Penney ..... 366/312
5,634,169 A 5/1997 Barry et al.
5,835,827 A * 11/1998 Kishimoto ..... 399/254
5,875,378 A 2/1999 Campbell et al.
5,884,130 A * 3/1999 Tsutsumi et al. ..... 399/254
6,181,904 B1 1/2001 Burdette et al.

* cited by examiner

*Primary Examiner*—Susan S. Y. Lee
(74) *Attorney, Agent, or Firm*—John A. Brady

(57) ABSTRACT

A toner cartridge for use in a laser printer has a toner reservoir or hopper in which a first paddle rotates about a fixed first axis to sweep most of the toner volume of the cartridge to agitate and push the toner out of the toner reservoir or hopper through an exit port. A second paddle is pivotally mounted on the first paddle to sweep a volume of the toner reservoir or hopper in which a portion of the longitudinal wall of the toner reservoir or hopper of the toner cartridge is non-circular so as to produce a reduced cross section in the toner reservoir or hopper. The second paddle also initially engages the curved portion of the inner surface of the longitudinal wall of the toner reservoir or hopper and preferably has a tear drop cross section.

28 Claims, 17 Drawing Sheets

TONER CARTRIDGE

FIELD OF THE INVENTION

This invention relates to an improved toner cartridge for use in a laser printer and, more particularly, to a toner cartridge for use in a laser printer in which more of the toner is effectively utilized with an additional paddle for moving toner not moved by a main or first paddle.

BACKGROUND OF THE INVENTION

It has previously been suggested in U.S. Pat. No. 5,875,378 to Campbell et al, which is incorporated by reference herein, to use a single paddle to sweep a hopper or toner reservoir in a toner cartridge of a laser printer to agitate the toner therein and produce more effective utilization thereof.

Because of the internal geometry of the toner reservoir or hopper of the toner cartridge in the aforesaid Campbell et al patent, the single paddle of the aforesaid Campbell et al patent is incapable of reaching all volumes of the toner reservoir or hopper. This is because a portion of the hopper or toner reservoir has a non-circular portion, which results in a smaller cross section of the hopper or toner reservoir, in its bottom adjacent one of its end walls.

As a result, a significant amount of toner is not used at the end of the life of a toner cartridge. Some of this unused toner can be utilized through a user shaking the toner cartridge after removing it from the laser printer and then returning the toner cartridge to the laser printer after shaking.

The toner moving paddle in the aforesaid Campbell et al patent has been constructed so that its outer toner moving bar avoids sweeping the non-circular portion of the hopper or toner reservoir. The non-circular portion constitutes an inset in the inner surface of the toner reservoir or hopper wall to provide increased space exterior of the toner reservoir or hopper for rollers in the laser printer for feeding each sheet of a medium for printing.

Additionally, it has previously been suggested in U.S. Pat. No. 5,634,169 to Barry et al, which is incorporated by reference herein, to use a toner level sensing system in a toner cartridge of the type shown and described in the aforesaid Campbell et al patent. This toner level sensing system senses the level of the toner in the toner cartridge by sensing the torque created by the toner on the moving paddle because the torque on the moving paddle is reduced as the toner level decreases. Thus, any structure producing an additional torque on the toner moving paddle during each revolution of the toner moving paddle would render the toner level sensing system ineffective, particularly at relatively low levels of toner in the toner cartridge.

Furthermore, an improved toner, insofar as reducing the required fuser temperature, has substantially worse powder flow and angle of repose properties than the prior toner. These properties increase the propensity of the improved toner to cling to portions of the hopper or toner reservoir that are not reached by the single paddle of the aforesaid Campbell et al patent. This also affects the ability to deliver toner to a developer roll of the laser printer.

The improved toner is monocomponent, which can become stagnant and cohesive when left undisturbed for a period of time. This stagnation and settling of the toner may be aggravated by the slight vibrations generated by the printer motor and gear train in a laser printer.

SUMMARY OF THE INVENTION

The toner cartridge of the present invention utilizes a second paddle in conjunction with the first paddle to sweep most of the volume that the first paddle has been incapable of sweeping. Therefore, more of the toner is swept by the combined paddles of the present invention than by the single paddle in the aforesaid Campbell et al patent so that more toner is available for use.

The present invention has the second paddle pivotally supported on the first paddle, which revolves about a fixed first axis, so that the second paddle pivots about a second axis substantially parallel to the fixed first axis about which the first paddle revolves. Thus, sweeping of almost all of the volume of the toner reservoir is accomplished with the two paddles of the present invention.

The second paddle also engages a portion of the longitudinal wall of the toner reservoir to remove more of the toner therefrom than is accomplished with the first paddle. The first paddle has a slight clearance with respect to all of the walls of the toner reservoir.

The toner level sensing system of the aforesaid Barry et al patent is not affected by the use of the second paddle. This is because the toner level sensing system senses the torque when the first paddle is at substantially its lowermost position and the second paddle trails the first paddle so that it is not creating any significant torque when the torque on the first paddle is sensed by the toner level sensing system.

The use of the second paddle reduces the need for a user to shake the toner cartridge to obtain the use of more toner in the toner cartridge. This is because most of the toner, which could be dislodged by shaking, had already been removed by the second paddle.

This invention relates to a toner cartridge comprising a toner reservoir having toner therein and a first paddle rotatable in the toner reservoir about a fixed first axis. The toner reservoir has a first portion in which the toner therein is engaged by the first paddle to agitate the toner and to push the toner out of the toner reservoir during each revolution of the first paddle. A second paddle is pivotally supported on the first paddle for pivotal movement about a second axis substantially parallel to the fixed first axis in response to each revolution of the first paddle about the fixed first axis. The toner reservoir has a second portion in which the toner therein is not engaged by the first paddle during each revolution of said first paddle about the fixed first axis. The second paddle includes a toner moving element for moving through the second portion of the toner reservoir in response to each revolution of the first paddle through the toner reservoir to engage the toner in the second portion of the toner reservoir to agitate the toner and to push the toner out of the toner reservoir during each revolution of the first paddle.

An object of this invention is to provide a toner cartridge for a laser printer to permit agitation of a larger volume of the toner within the hopper or toner reservoir of the toner cartridge.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
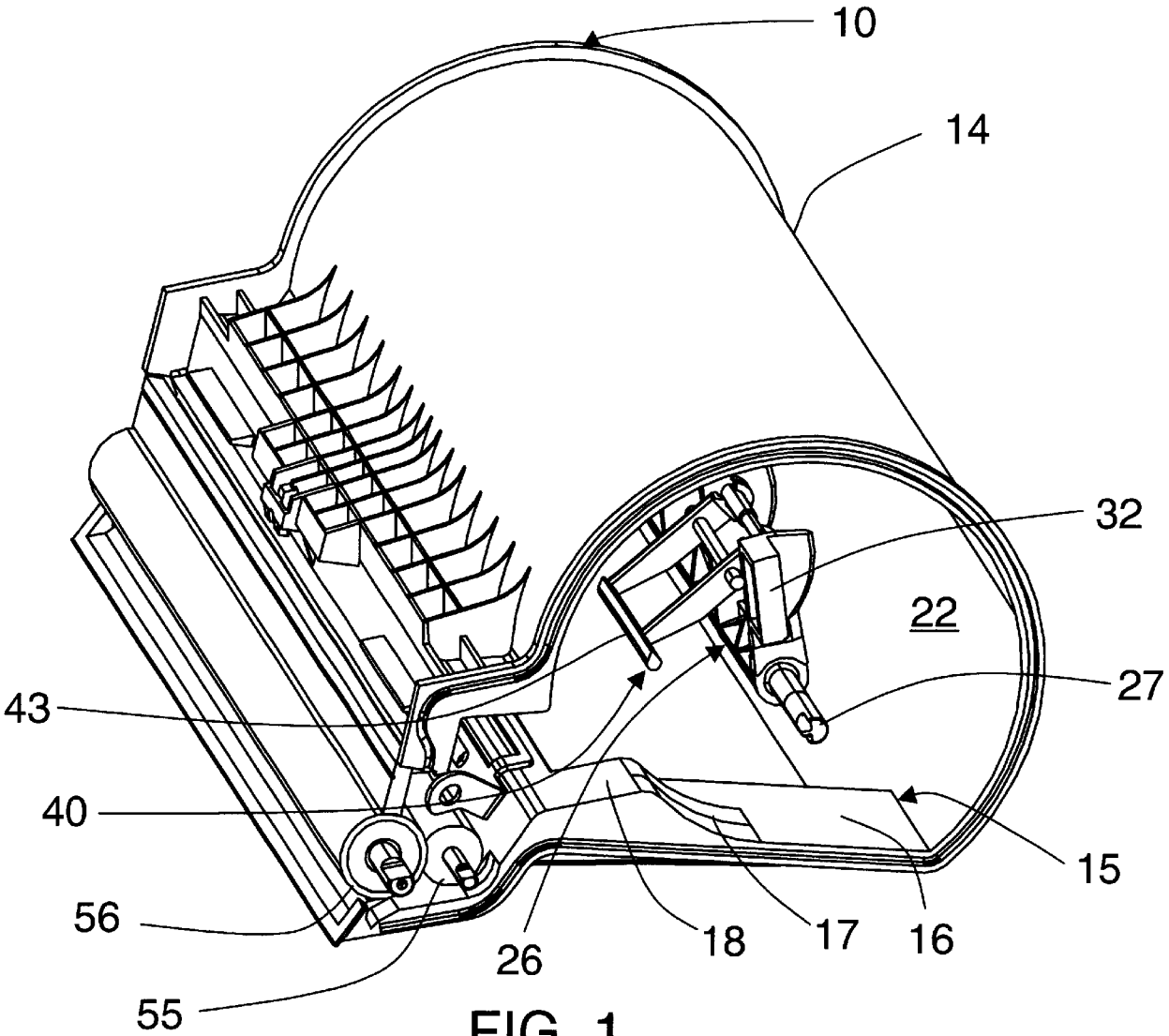
FIG. 1 is a partial cut-away perspective view of a portion of a toner cartridge of a laser printer taken from its left side where left is determined facing a laser printer from its front side in which insertion of the toner cartridge is made with the toner cartridge having a first or main paddle for pivotally supporting a second or auxiliary paddle of the present invention.

Referring to the drawings and particularly FIG. 1, there is shown a toner cartridge 10 for use in a laser printer. The positioning of the toner cartridge 10 in a laser printer is particularly shown and described in the aforesaid Campbell et al patent. U.S. Pat. No. 6,181,904 B1 to Burdette et al, which is incorporated by reference herein, also discloses a toner cartridge.

Figure 15:
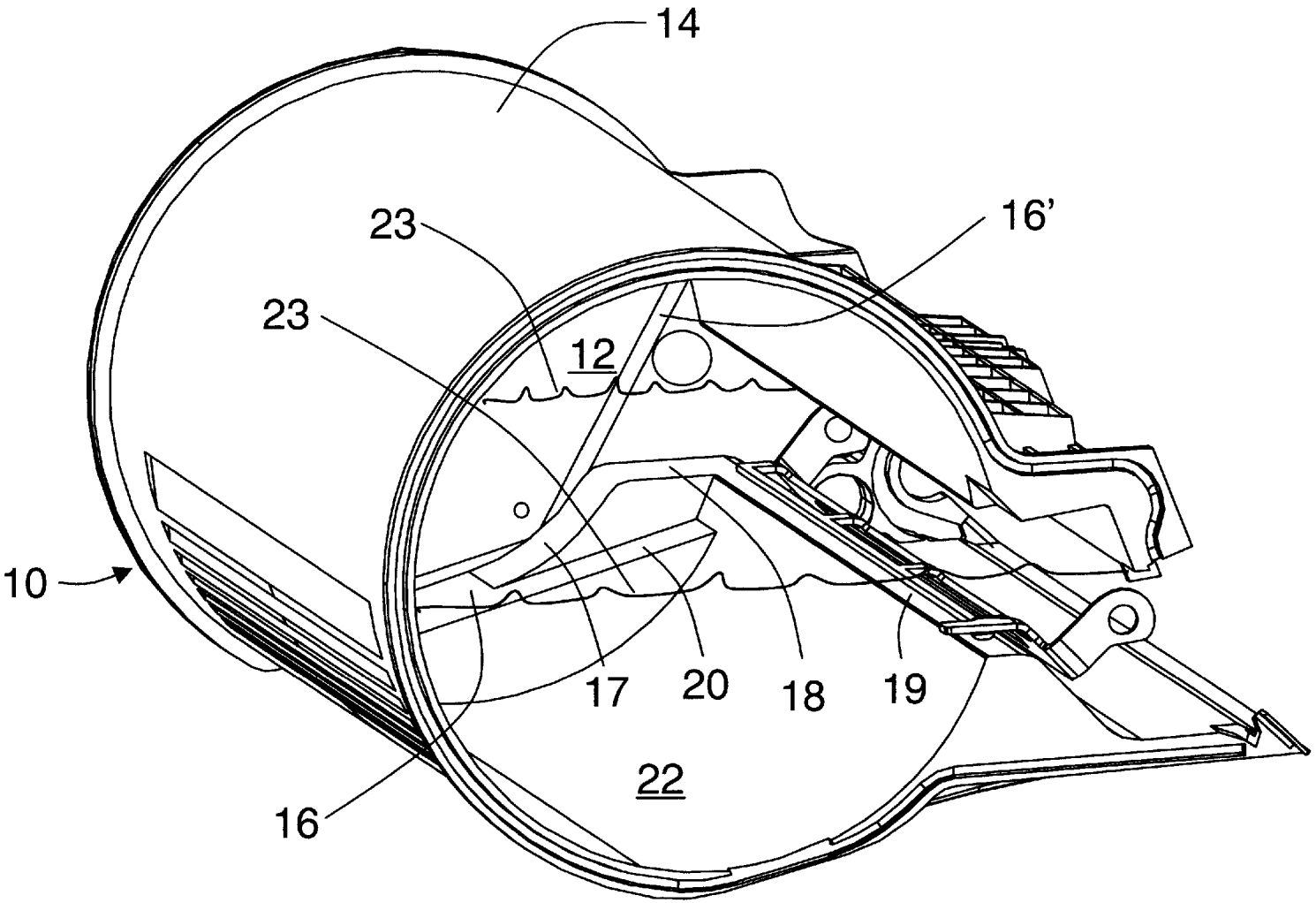
FIG. 15 is a right front perspective view of the toner cartridge with an end wall removed.

The toner cartridge 10 includes a right end wall 11 (see FIG. 5) and a left end wall 12 (see FIG. 15) with each having a circular shape of the same radius. As more particularly shown and described in the aforesaid Campbell et al patent, a longitudinal wall 14 extends between the end walls 11 (see FIG. 5) and 12 (see FIG. 15). As more particularly shown and described in the aforesaid Campbell et al patent, the longitudinal wall 14 (see FIG. 5) is curved for slightly less than 360° with its curved shape having the same radius as the circular shape of each of the end walls 11 and 12 (see FIG. 15).

Figure 5:
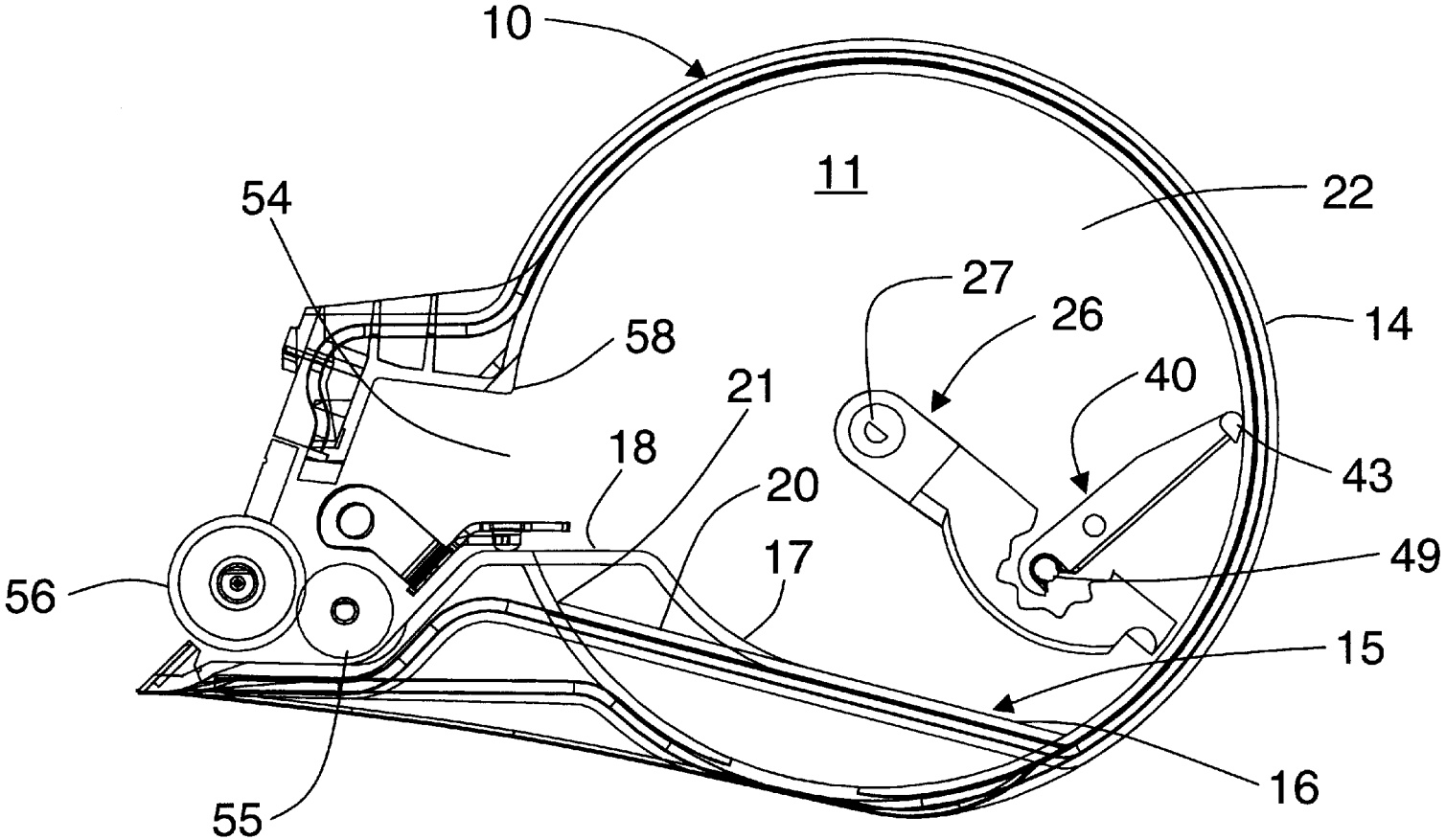
FIG. 5 is a left side elevational view of the toner cartridge with its left end wall removed along with a portion of an inset adjacent the removed left end wall and showing the second paddle making initial contact with a curved longitudinal wall of the toner cartridge and the position of the second paddle relative to the first paddle.
Figure 6:
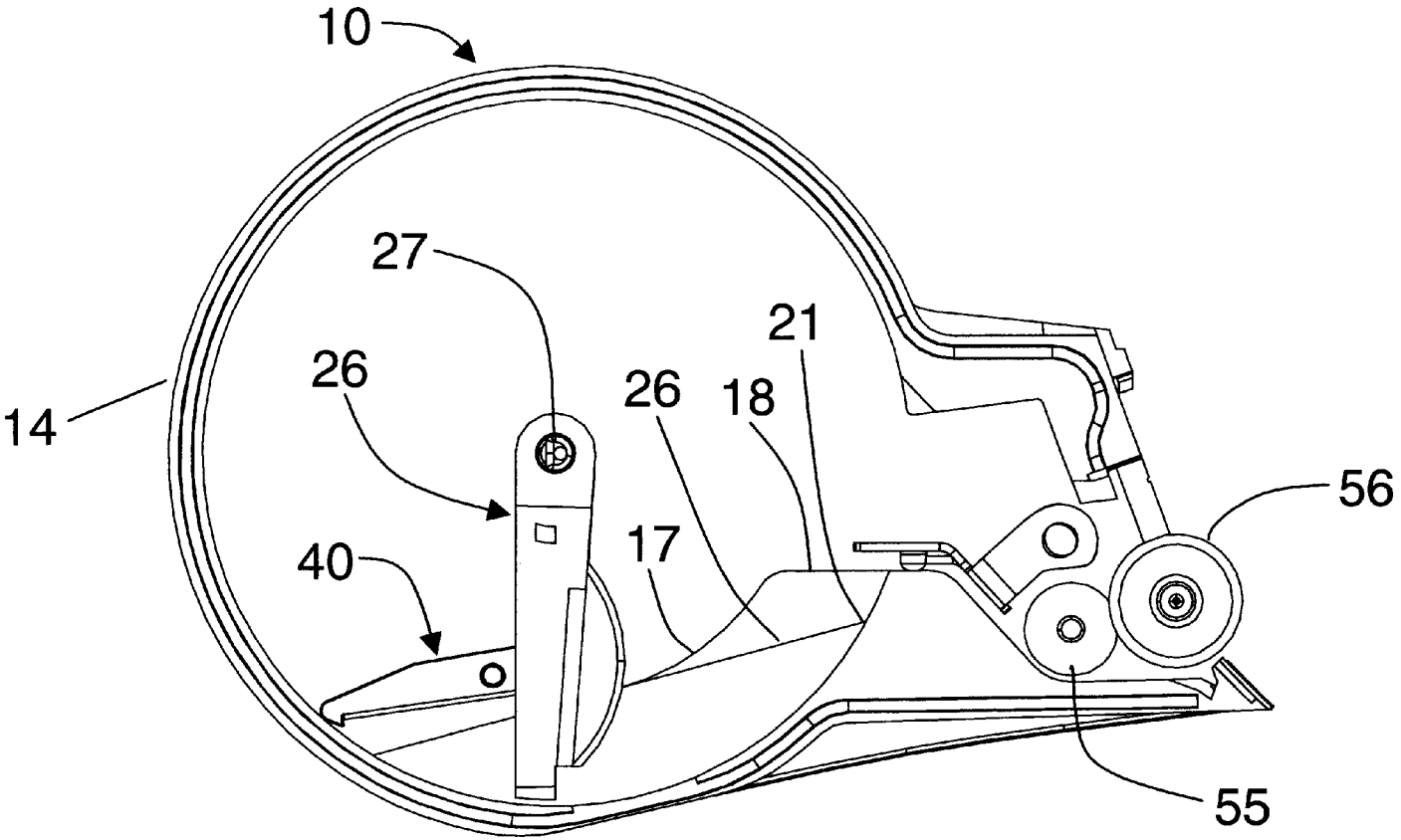
FIG. 6 is a right side elevational view of the toner cartridge with both end walls removed along with a portion of an inset adjacent the removed left end wall omitted for clarity purposes and showing the second paddle in a position in which it engages a wall of the cartridge during its movement with the first paddle.

As more particularly shown and described in the aforesaid Campbell et al patent, the longitudinal wall 14 (see FIG. 1) has an inset 15 at its left end. The inset 15 includes an inclined flat surface 16, which extends inwardly from the left end wall 12 (see FIG. 15) and is integral with the left end wall 12 and the longitudinal wall 14 as shown in FIG. 5.

An outer portion of the inclined flat surface 16 of the inset 15 has an inclined surface 16' (see FIG. 15) extending upwardly therefrom and integral with the left end wall 12. A middle portion of the inclined flat surface 16 (see FIG. 5) has a rising curved portion 17 terminate in an inclined flat surface 18 of a rear wall 19 (see FIG. 15) as more particularly shown and described in the aforesaid Campbell et al patent. An innermost portion of the inclined flat surface 16 (see FIG. 5) continues as a straight flat surface 20 until it engages a curved portion of the longitudinal wall 14 as indicated at 21.

As more particularly shown and described in the aforesaid Campbell et al patent, the right end wall 11, the left end wall 12 (see FIG. 15), and the longitudinal wall 14 define a toner reservoir or hopper 22. Toner, which has its level indicated in FIG. 15 by surface lines 23, is retained in the hopper or toner reservoir 22.

A first or main paddle 26 (see FIG. 2) is rotatably supported by the end walls 11 (see FIG. 5) and 12 (see FIG. 15) in the manner shown and described in the aforesaid Campbell et al patent. The first paddle 26 (see FIG. 2) includes a shaft 27, which extends through the left end wall 12 (see FIG. 15), to be driven preferably in the manner shown and described in the aforesaid Campbell et al patent.

The first paddle 26 (see FIG. 2) includes an outer toner moving bar 28, which extends across most of the axial length of the hopper 22 (see FIG. 1) where the cross section is substantially constant and not reduced by the inset 15. The outer toner moving bar 28 (see FIG. 2) is supported at the end of each of a plurality of support struts 29 extending from a central portion 30, which has a substantially cross configuration, of the shaft 27.

Figure 3:
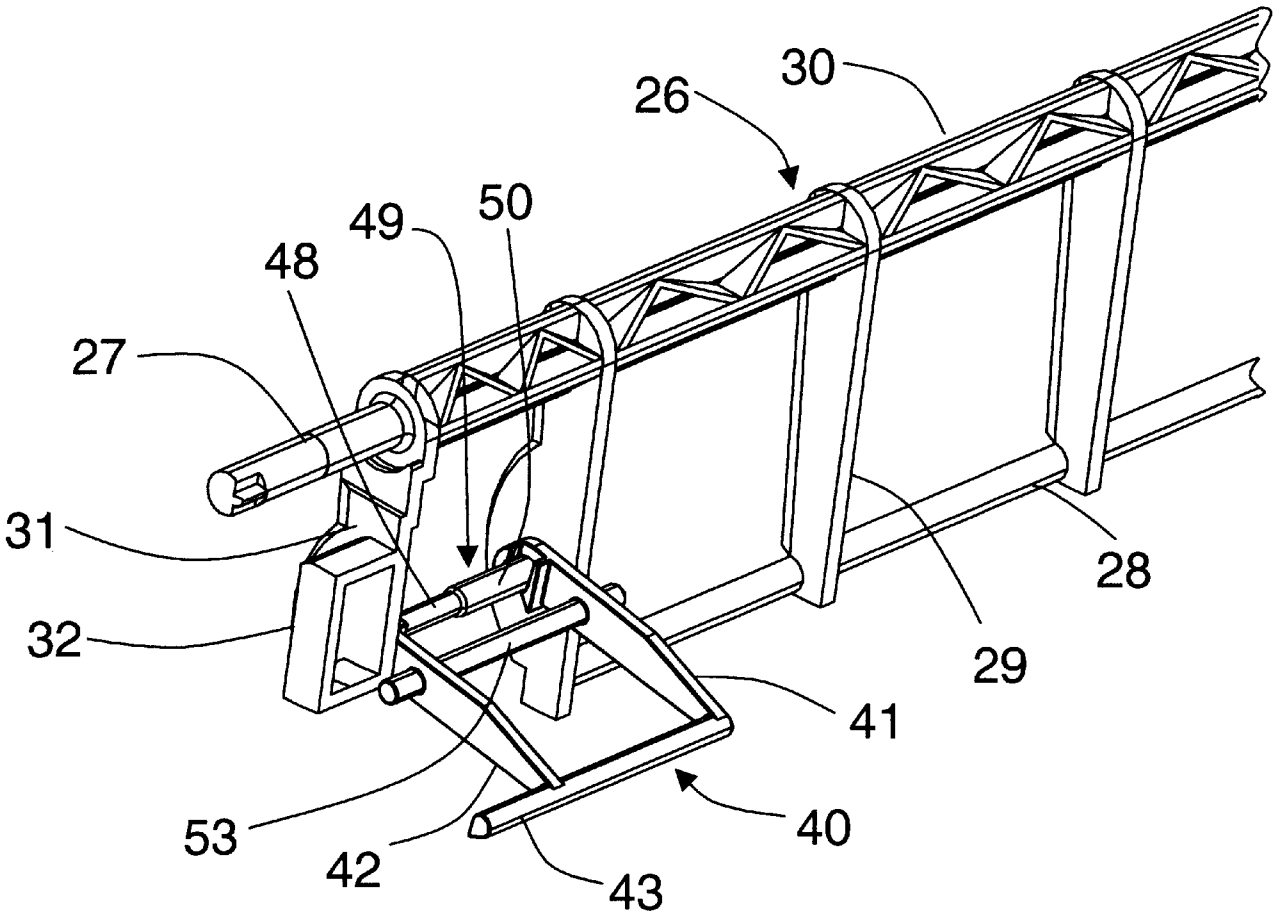
FIG. 3 is a perspective view taken from the left front and showing the second paddle in a position in which it engages a wall of the cartridge during its movement with the first paddle.
Figure 13:
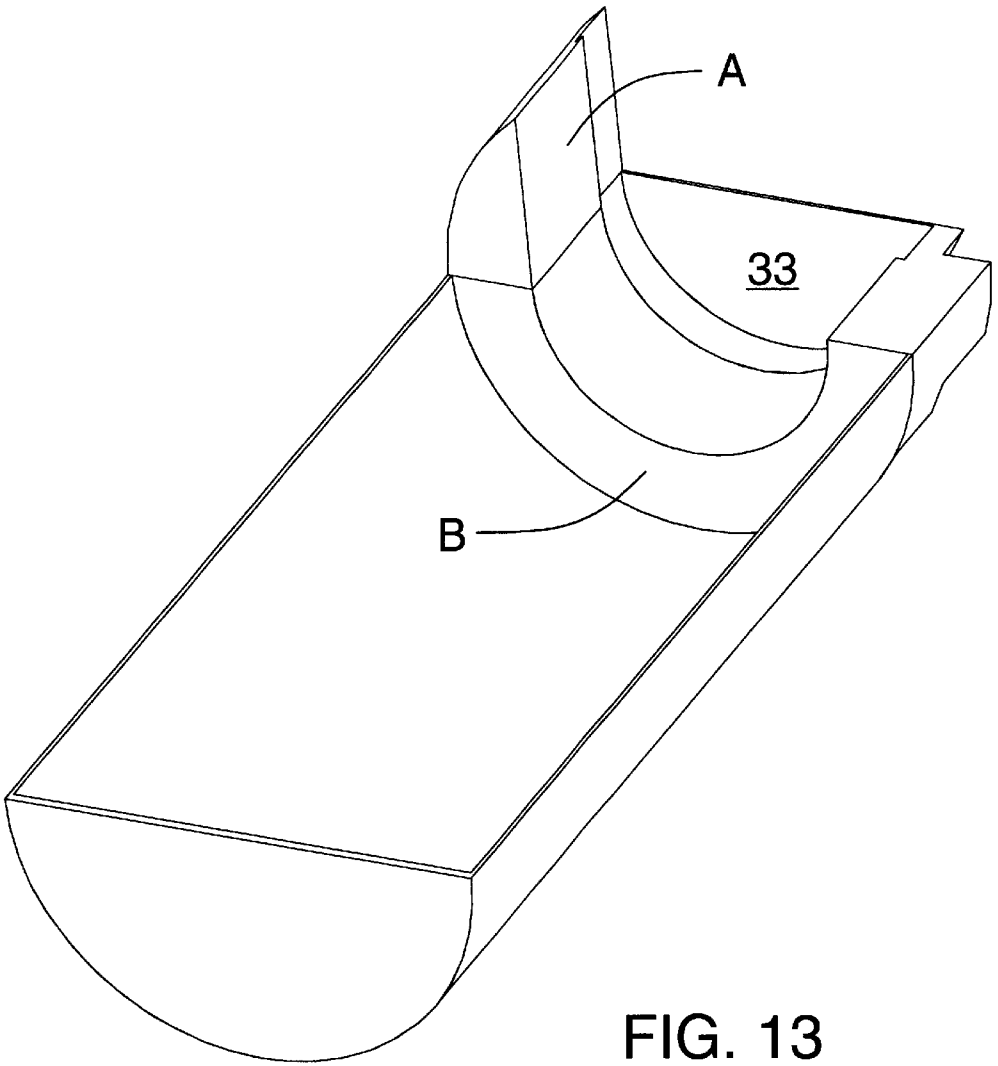
FIG. 13 is a schematic perspective view of unswept volumes of toner in the toner cartridge by only the first paddle.

The outer toner moving bar 28 has a slight clearance with the inner surface of the longitudinal wall 14 (see FIG. 1) during rotation of the first paddle 26 about a fixed axis. As a result, the first paddle 26 sweeps across the hopper or toner reservoir 22 but leaves unswept volumes of toner therein as shown in FIG. 13 including volumes away from the inner surface of the longitudinal wall 14 (see FIG. 1). The unswept volumes of FIG. 13 are those in which the toner remains after each revolution of the first paddle 26 (see FIG. 3).

The first paddle 26 has an additional support strut 31 forming part of a hollow rectangular shaped portion 32 on its left end. The hollow rectangular shaped portion 32 does not extend as far from the axis of the shaft 27 as the outer toner moving bar 28 because of the reduced inner surface of the toner reservoir or hopper 22 (see FIG. 1) due to the presence of the inset 15. However, the hollow rectangular shaped portion 32 (see FIG. 3) of the first paddle 26 can sweep some toner off the semicircular lower portion of the left end wall 12 (see FIG. 15). This leaves an unswept volume 33 (see FIG. 13) because there is clearance of the first paddle 26 with any inner surface of the toner cartridge 10 (see FIG. 1).

Figure 2:
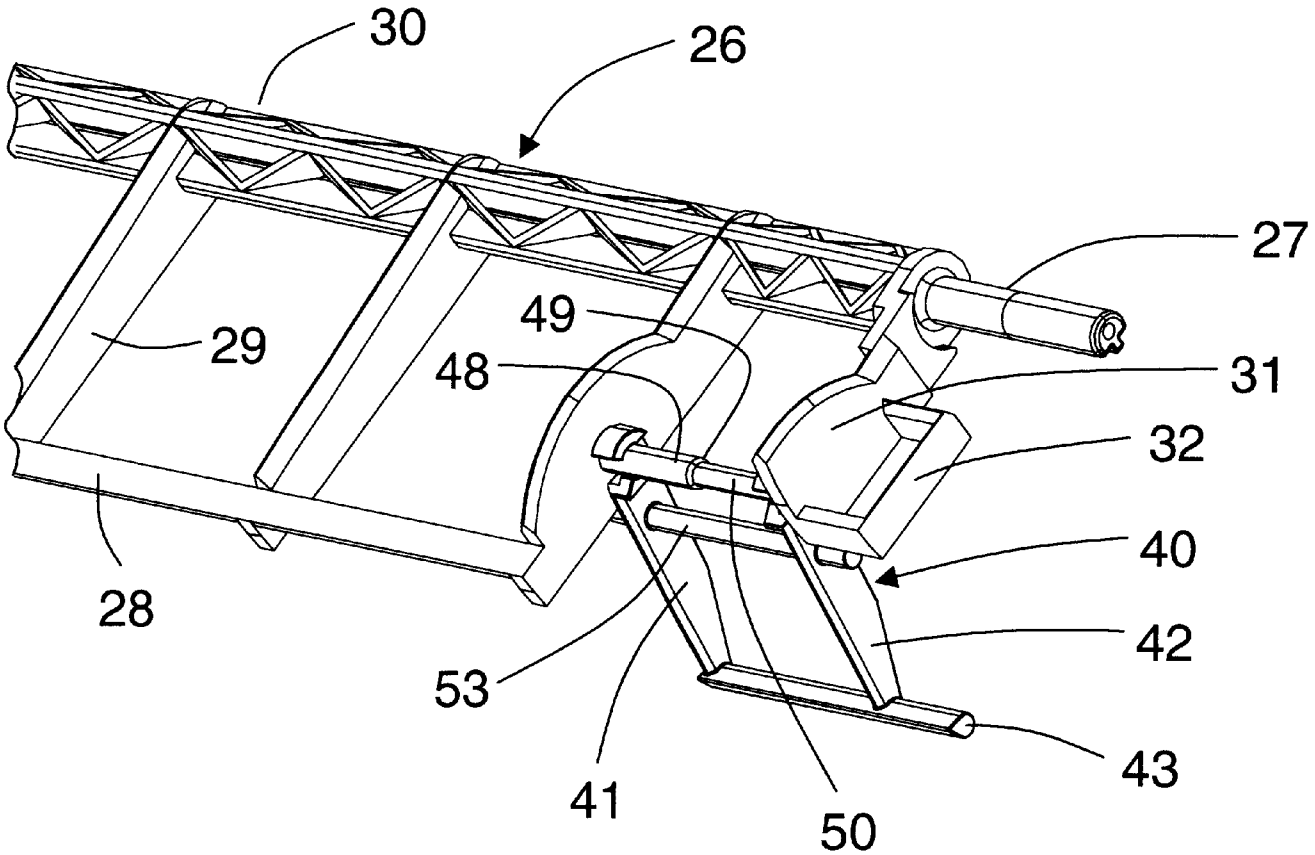
FIG. 2 is a perspective view of a preferred embodiment of the second paddle pivotally supported on the first paddle taken from the left rear and showing the second paddle in a different position from that in FIG. 1.

Thus, FIG. 13 discloses unswept volumes left by the first paddle 26 (see FIG. 2). The unswept volumes in FIG. 13 also are indicative of where the toner is removed in the toner reservoir or hopper 22 (see FIG. 1) by the first paddle 26 (see FIG. 2).

Figure 8:
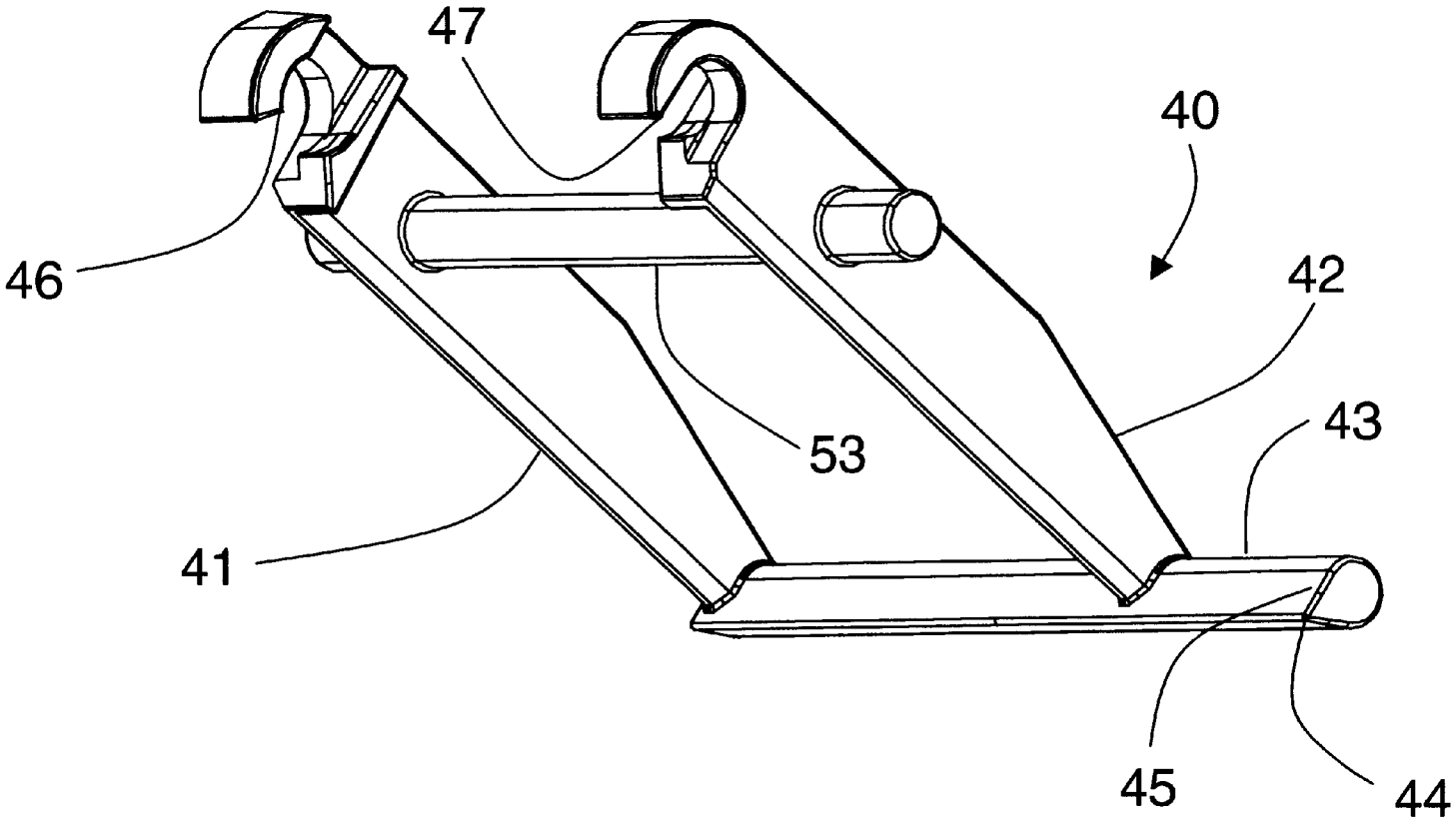
FIG. 8 is an enlarged perspective view of the preferred embodiment of the second paddle.

Accordingly, a second paddle 40 is pivotally mounted on the first paddle 26 so that it can pivot about an axis, which is parallel to the fixed axis about which the shaft 27 of the first paddle 26 rotates. As shown in FIG. 8, the second paddle 40 has a pair of substantially parallel support arms 41 and 42 having an outer toner moving bar 43 attached thereto at one end of each of the support arms 41 and 42.

Figure 4:
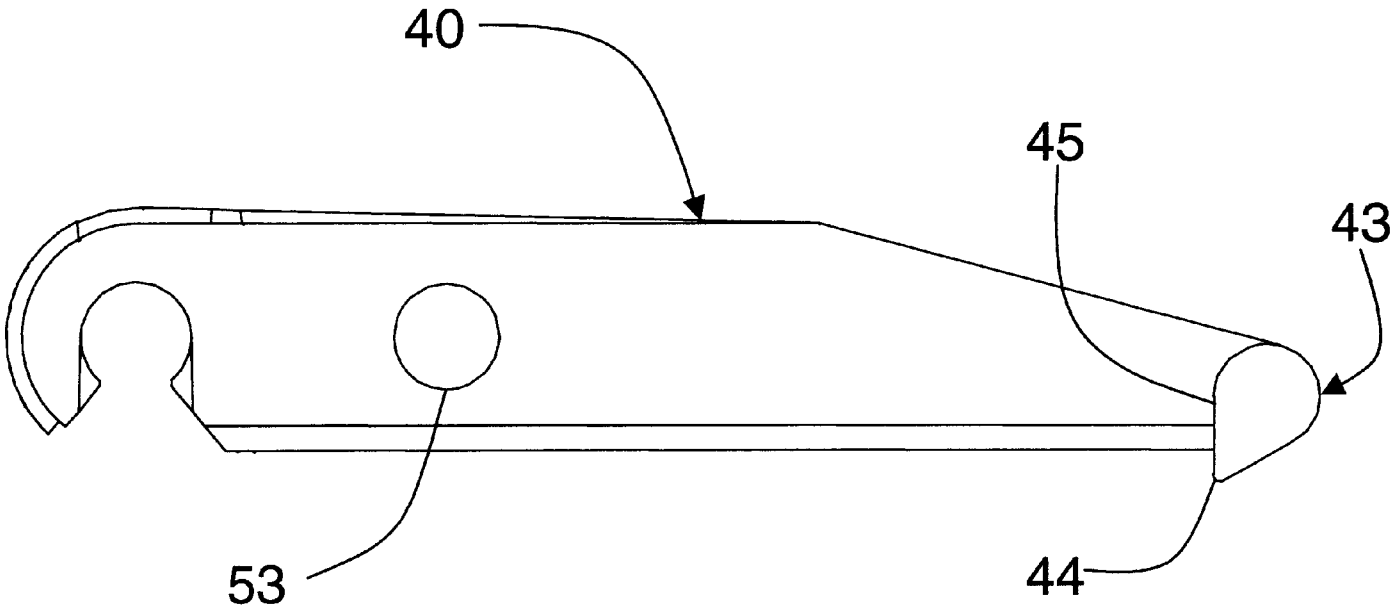
FIG. 4 is an enlarged side elevational view of a preferred embodiment of the second paddle of the present invention.

In the preferred embodiment, the outer toner moving bar 43 has a tear drop cross section as shown in FIG. 4. The tear drop cross section includes a substantially sharp end edge 44, which dives into the toner initially for agitating the toner as the second paddle 40 pivots relative to the first paddle 26 (see FIG. 2). A toner engaging surface 45 (see FIG. 4) of the outer toner moving bar 43 extends away from the sharp end edge 44 and engages the toner as the second paddle 40 is advanced through the toner during each revolution of the first paddle 26 (see FIG. 2).

It should be understood that the substantially sharp end edge 44 (see FIG. 4) has a slight radius at its end. This is due to manufacturing requirements. For example, the slight radius is 0.2 mm while the substantially straight portion of the toner engaging surface 45 is 2.4 mm long.

Figure 9:
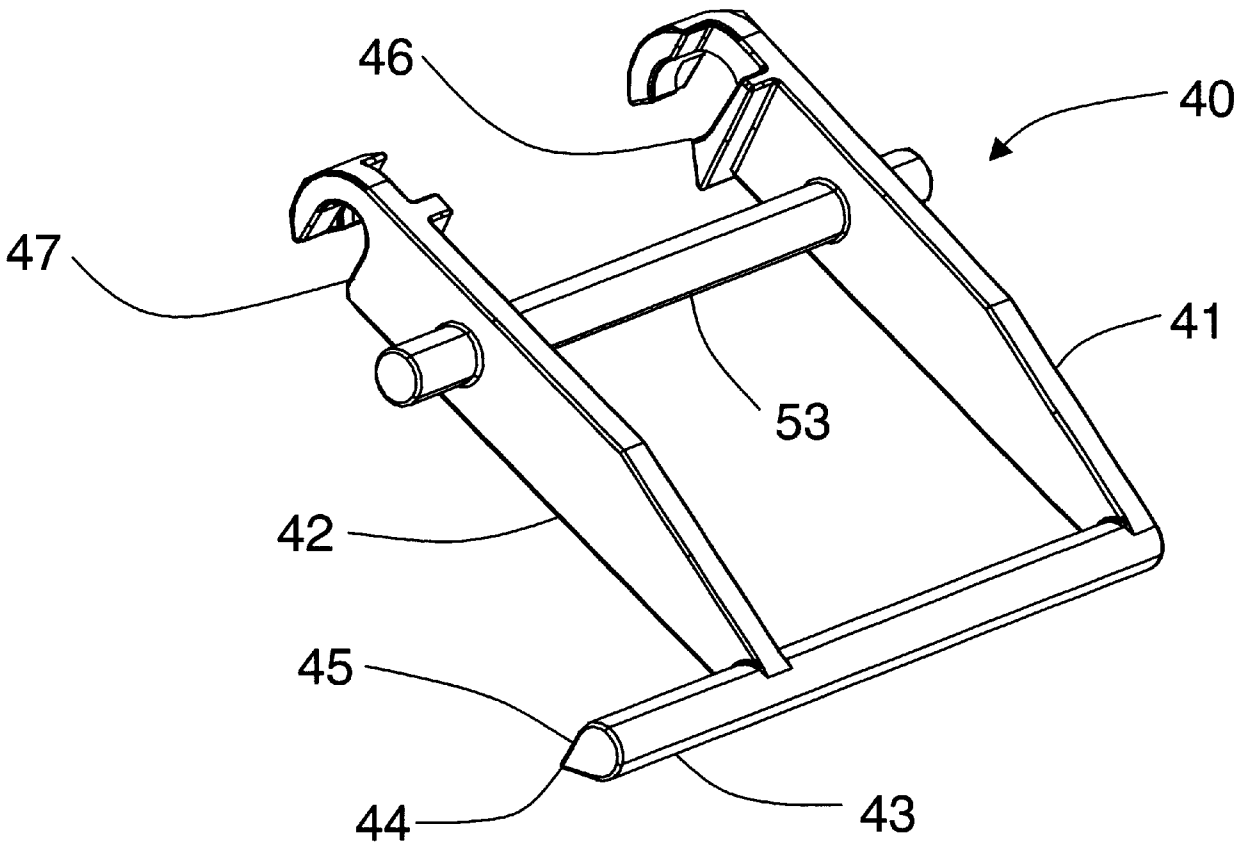
FIG. 9 is an enlarged perspective view of the second paddle of FIG. 8.

Each of the support arms 41 (see FIG. 9) and 42 has a cutout or slot 46 and 47, respectively, in its end remote from the outer toner moving bar 43. In the preferred embodiment, the cutout 46 in the support arm 41 receives a larger portion 48 (see FIG. 2) of a stepped pivot shaft 49. A smaller portion 50 of the stepped pivot shaft 49 is received in the cutout 47 (see FIG. 8) in the support arm 42.

This use of the stepped pivot shaft 49 (see FIG. 2) insures the correct installation of the second paddle 40 on the first paddle 26. Without the need to insure correct installation, the stepped pivot shaft 49 could have a constant diameter.

The stepped pivot shaft 49 extends between the support strut 29, which is adjacent the second paddle 40, and the additional support strut 31. The adjacent support strut 29 supports one end of the outer toner moving bar 28 of the first paddle 26. As previously mentioned, the additional support strut 31 supports the hollow rectangular shaped portion 32 on the first paddle 26.

The lengths of the support arms 41 and 42 insure that the second paddle 40 trails the first paddle 26 during each revolution of the first paddle 26. That is, the support arms 41 and 42 create an effective radius greater than the radius of the inner surface of the longitudinal wall 14 (see FIG. 1) so that the second paddle 40 always trails the first paddle 26.

A stop pin 53 (see FIG. 8) is supported by the support arms 41 and 42 of the second paddle 40 and extends beyond each of the support arms 41 and 42. The extending ends of the stop pin 53 engage the adjacent support strut 29 (see FIG. 2) and the additional support strut 31 of the first paddle 26 to control when the second paddle 40 flips over the top during each revolution of the first paddle 26 to have the outer toner moving bar 43 of the second paddle 40 engage the longitudinal wall 14 (see FIG. 1). The stop pin 53 (see FIG. 2) also maintains the orientation of the second paddle 40 relative to the first paddle 26 and the relation of the outer toner moving bar 43 to the inset 15 (see FIG. 5).

The outer toner moving bar 43 (see FIG. 8) of the second paddle 40 extends outwardly beyond the outer side of the support arm 42. This enables the outer toner moving bar 43 to almost abut the left end wall 12 (see FIG. 15) and have its end in substantially the same plane as the outer surface of the hollow rectangular shaped portion 32 (see FIG. 3) of the first paddle 26.

Figure 14:
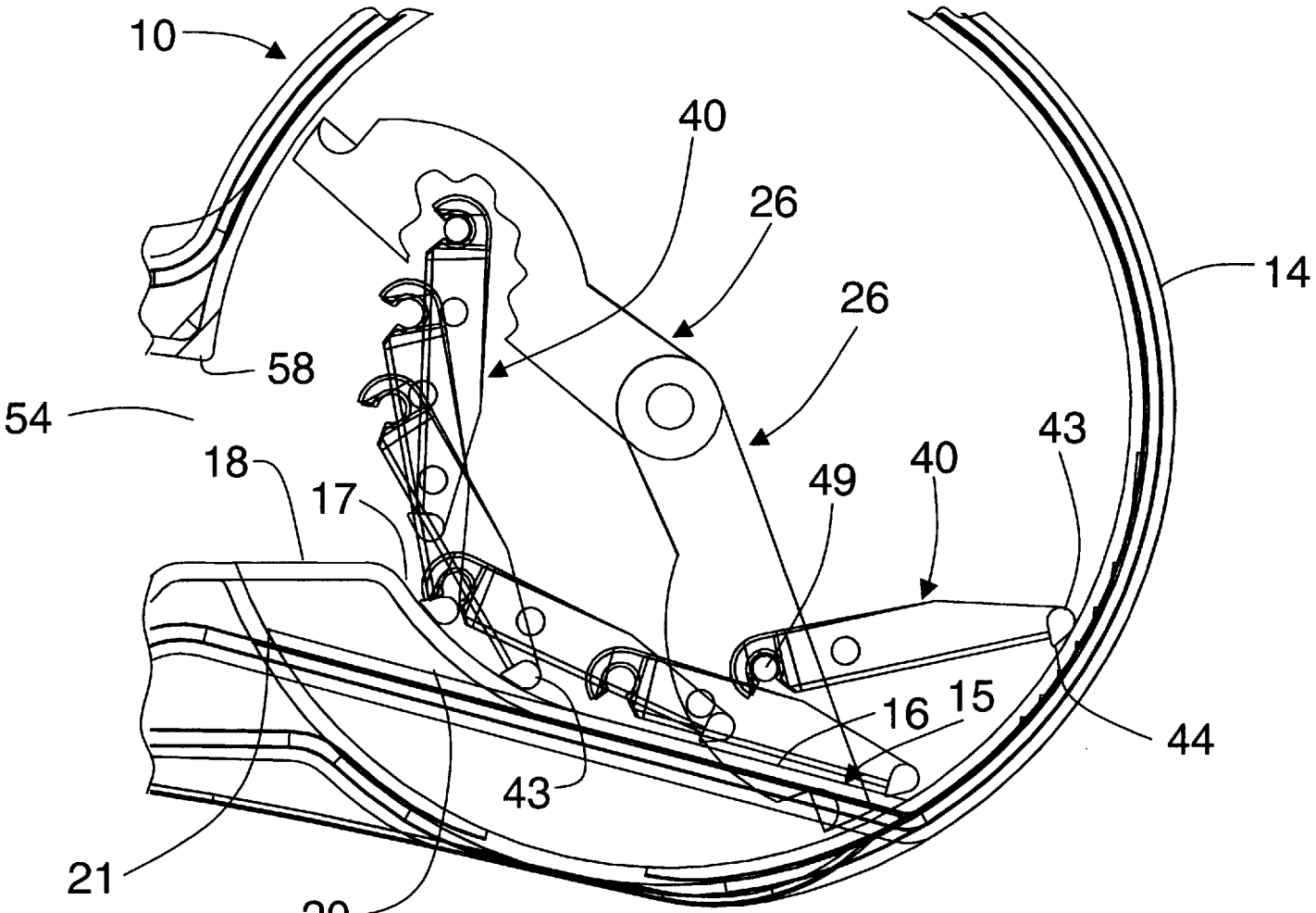
FIG. 14 is an enlarged fragmentary left side elevational view, similar to FIG. 5, with both end walls removed along with a portion of an inset adjacent the removed left end wall and showing various positions of the second paddle relative to the first paddle in the interior of the toner reservoir during a portion of a revolution of the first paddle.

During each revolution of the first paddle 26, the outer toner moving bar 43 (see FIG. 8) of the second paddle 40 initially engages the inner surface of the longitudinal wall 14 at the position shown in FIG. 5. The continued clockwise pivotal movement of the outer toner moving bar 43 about the axis of the stepped shaft 49 (see FIG. 2) in response to clockwise rotation of the first paddle 26 ceases to be effective after the outer toner moving bar 43 leaves the rising curved portion 17 (see FIG. 14) of the inset 15.

In the same manner as described in the aforesaid Campbell et al patent for the movement of the toner out of the hopper or toner reservoir 22 (see FIG. 1) by the first paddle 26, the second paddle 40 also moves the toner in the same manner out of the hopper 22. Thus, the toner is pushed over the rear wall 19 (see FIG. 15).

Figure 7:
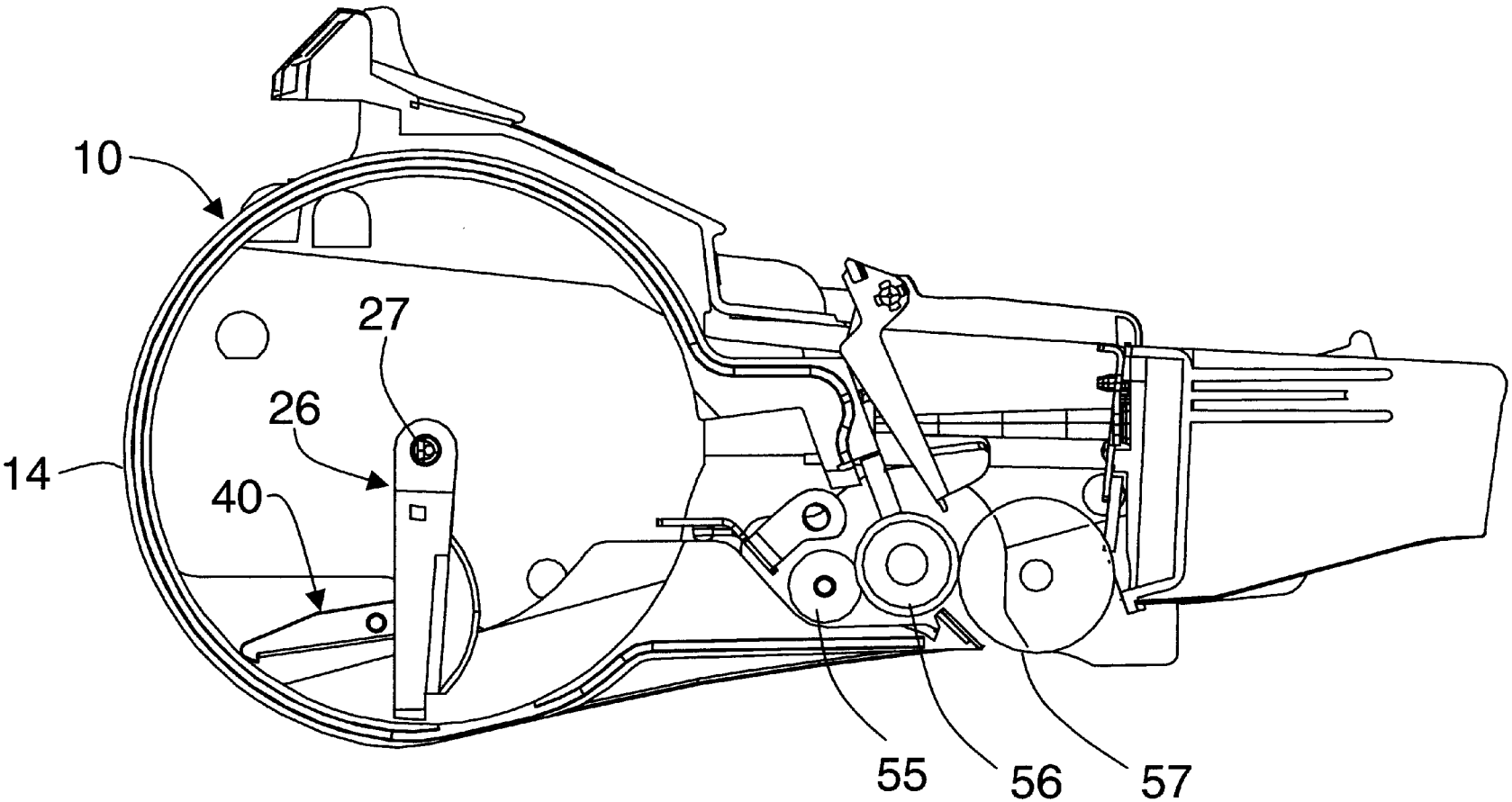
FIG. 7 is a right side elevational view, similar to FIG. 6, with both end walls removed along with a portion of an inset adjacent the removed left end wall omitted for clarity purposes and showing additional structure of the toner cartridge.

As described in the aforesaid Campbell et al patent, the toner is pushed over the rear wall 19 (see FIG. 15) through an exit port or opening 54 (see FIG. 5) to a toner adder roll 55 and then to a developer roll 56 for application to a photoconductive drum 57 (see FIG. 7) of the laser printer as particularly shown and described in the aforesaid Campbell et al and Burdette et al patents. As shown in FIG. 5, the exit port or opening 54 is defined by a terminal end 58 of the circular shape of the longitudinal wall 14 and the flat surface 18 of the rear wall 19 (see FIG. 15).

Figure 10:
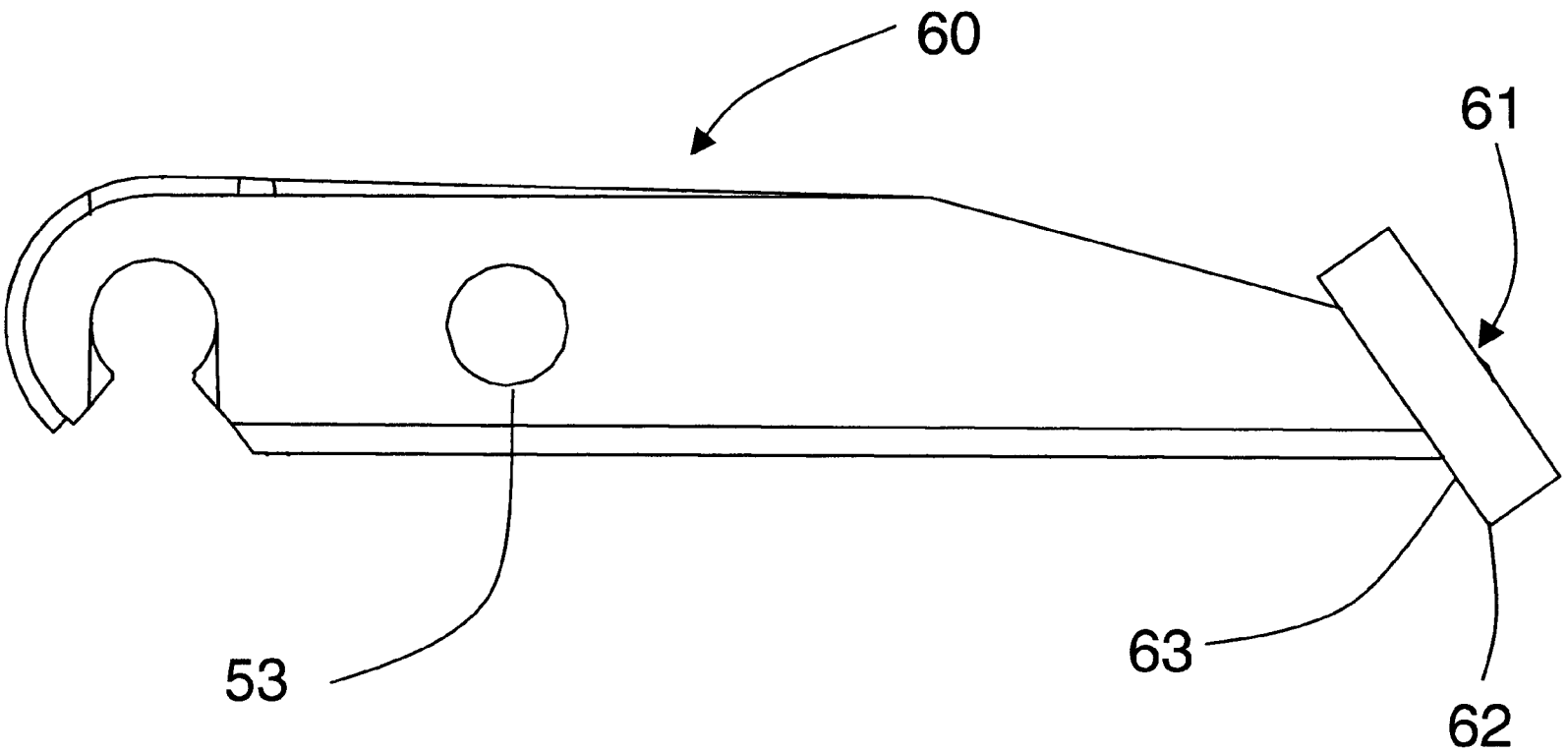
FIG. 10 is an enlarged side elevational view of another embodiment of the second paddle.

The second paddle 40 (see FIG. 4) has the preferred embodiment of the cross section of the outer toner moving bar 43. A second paddle 60 (see FIG. 10) is the same as the second paddle 40 (see FIG. 4) except that the second paddle 60 (see FIG. 10) has an outer toner moving bar 61 of a rectangular cross section. The outer toner moving bar 61 includes a sharp end edge 62 and a toner engaging surface 63.

Figure 11:
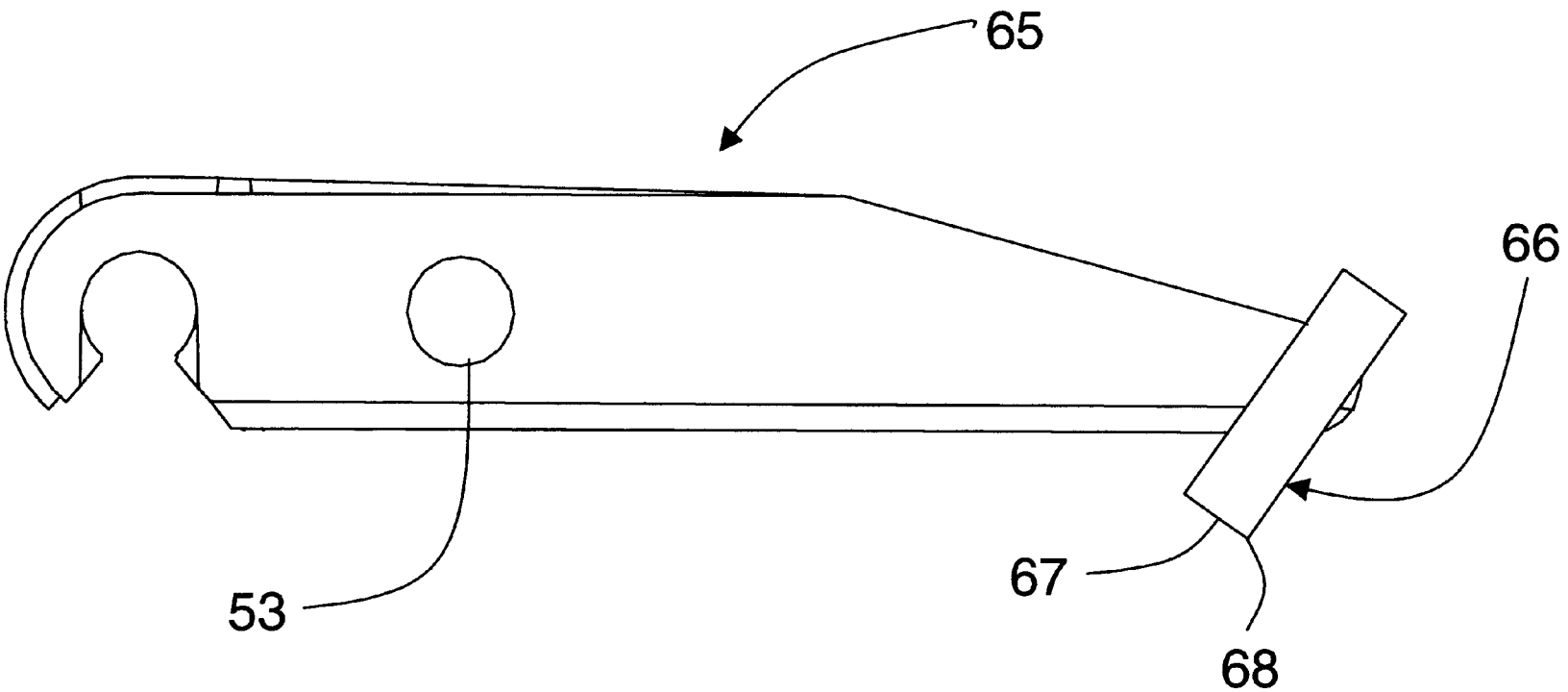
FIG. 11 is an enlarged side elevational view of a further modification of the second paddle of the present invention.

FIG. 11 discloses a second paddle 65 having its outer toner moving bar 66 of the same rectangular cross section as the outer toner moving bar 61 (see FIG. 10) of the second paddle 60. However, the outer toner moving bar 66 (see FIG. 11) has its toner engaging surface 67 extending from its sharp end edge 68 for a much shorter distance.

Figure 16:
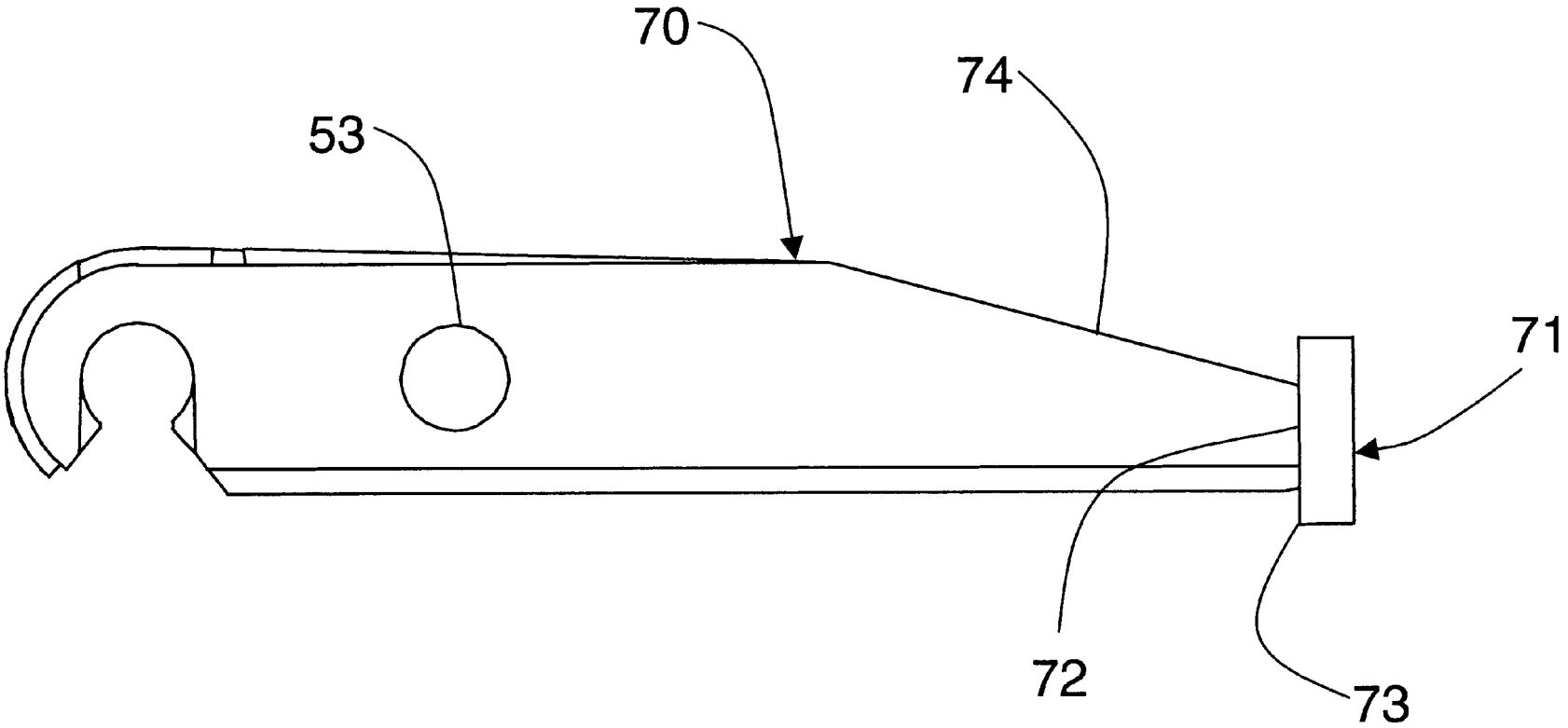
FIG. 16 is an enlarged side elevational view of still another embodiment of the second paddle.

FIG. 16 shows a second paddle 70 having its outer toner moving bar 71 of the same rectangular cross section as the outer toner moving bar 66 (see FIG. 11) of the second paddle 65 and the outer toner moving bar 61 (see FIG. 10) of the second paddle 60. However, the outer toner moving bar 71 (see FIG. 16) has its toner engaging surface 72 extending from its sharp end edge 73 substantially perpendicular to the bottom edge of each of its support arms 74 (one shown).

Figure 17:
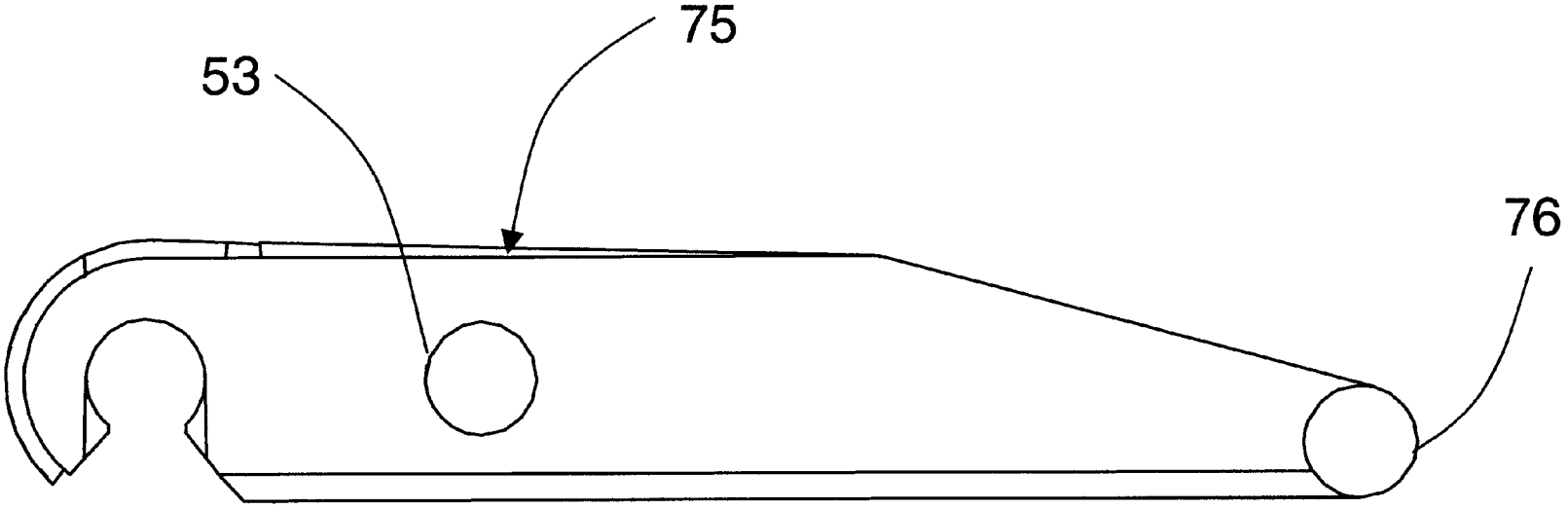
FIG. 17 is an enlarged side elevational view of a further modification of the second paddle.

FIG. 17 discloses a second paddle 75 having an outer toner moving bar 76 of circular cross section. There is no substantially sharp end edge in this embodiment.

The outer toner moving bar 44 (see FIG. 8) of the second paddle 40 is significantly better in delivering toner than the circular outer toner moving bar 76 (see FIG. 17) of the second paddle 75. The outer toner moving bar 44 (see FIG. 8) of the second paddle 40 is better in delivering toner than the outer toner moving bar 71 (see FIG. 16) of the second paddle 70.

Figure 12:
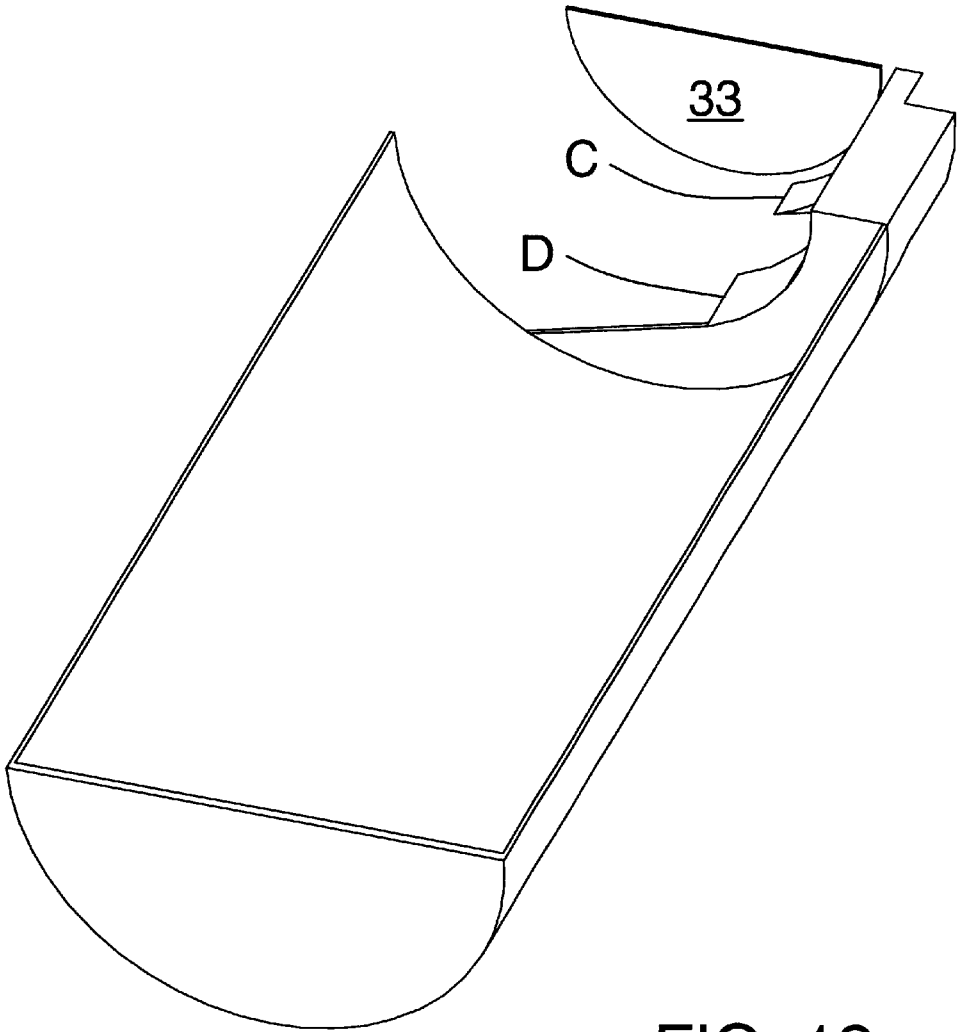
FIG. 12 is a schematic perspective view of unswept volumes of toner in the toner cartridge by the first and second paddles.

When comparing FIGS. 12 and 13, the second paddle 40 (see FIG. 4) sweeps a volume of toner identified as A in FIG. 13 and most of the volume of toner identified as B. As shown in FIG. 12, the volumes A and B of FIG. 13 have been removed by the second paddle 40 (see FIG. 4) except for two volumes C and D also not swept by the second paddle 40 (see FIG. 8). This is because the rising curved portion 17 (see FIG. 1) of the inset 15 prevents the outer toner moving bar 43 of the second paddle 40, for example, from engaging either the inclined surface 16' (see FIG. 15) adjacent the left end wall 12 or the straight flat surface 20 of the inclined flat surface 16. It does this because the rising curved portion 17 extends further into the toner reservoir or hopper 22 (see FIG. 15).

An advantage of this invention is that there is less undeliverable toner within a toner cartridge for use in a laser printer. Another advantage of this invention is that it agitates a larger volume of toner within a toner cartridge for use in a laser printer. A further advantage of this invention is that there is no offset torque to degrade a torque based toner level sensing system.

For purposes of exemplification, preferred embodiments of the invention have been shown and described according to the best present understanding thereof However, it will be apparent that changes and modifications in the arrangement and construction of the parts thereof may be resorted to without departing from the spirit and scope of the invention.

What is claimed is:

1. A toner cartridge comprising:

a toner reservoir having toner therein;

a first paddle rotatable in said toner reservoir about a fixed first axis;

said toner reservoir having a first portion in which the toner therein is engaged by said first paddle to agitate the toner and to push the toner out of said toner reservoir during each revolution of said first paddle;

a second paddle pivotally supported on said first paddle for pivotal movement about a second axis substantially parallel to the fixed first axis in response to each revolution of said first paddle about the fixed first axis;

said toner reservoir having a second portion in which the toner therein is not engaged by said first paddle during each revolution of said first paddle about the fixed first axis;

and said second paddle including a toner moving element for moving through said second portion of said toner reservoir in response to each revolution of said first paddle through said toner reservoir to engage the toner in said second portion of said toner reservoir to agitate the toner and to push the toner out of said toner reservoir during each revolution of said first paddle.

2. The toner cartridge according to claim 1 in which said toner moving element of said second paddle has a substantially sharp end edge for initially engaging the toner in said second portion of said toner reservoir to agitate the toner.

3. The toner cartridge according to claim 2 in which said toner moving element of said second paddle has a toner engaging surface extending from said substantially sharp end edge of said second paddle to engage the toner in said toner reservoir after said substantially sharp end edge has engaged the toner in said toner reservoir and to push the toner out of said toner reservoir.

4. The toner cartridge according to claim 3 in which said toner moving element of said second paddle has a tear drop cross section defining said substantially sharp end edge and said toner engaging surface.

5. The toner cartridge according to claim 4 including means for insuring that said second paddle trails said first paddle during each revolution of said first paddle through said toner reservoir.

6. The toner cartridge according to claim 3 including means for insuring that said second paddle trails said first paddle during each revolution of said first paddle through said toner reservoir.

7. The toner cartridge according to claim 2 including means for insuring that said second paddle trails said first paddle during each revolution of said first paddle through said toner reservoir.

8. The toner cartridge according to claim 1 including means for insuring that said second paddle trails said first paddle during each revolution of said first paddle through said toner reservoir.

9. The toner cartridge according to claim 1 in which said toner moving element of said second paddle continues to agitate the toner and push the toner out of said second portion of said toner reservoir after said first paddle ceases to push the toner out of said first portion of said toner reservoir during each revolution of said first paddle.

10. A toner cartridge comprising:

a toner reservoir having toner therein a first paddle rotatable in said toner reservoir about a fixed first axis;

said toner reservoir having a first portion in which the toner therein is engaged by said first paddle to agitate the toner and to push the toner out of said toner reservoir during each revolution of said first paddle;

a second paddle pivotally supported by said first paddle for pivotal movement about a second axis substantially parallel to the fixed first axis in response to each revolution of said first paddle about the fixed first axis;

said toner reservoir having a second portion in which the toner therein is not engaged by said first paddle during each revolution of said first paddle about the fixed first axis;

said second paddle having a toner moving element for moving through said second portion of said toner reservoir in response to each revolution of said first paddle through said toner reservoir to engage the toner in said second portion of said toner reservoir to agitate the toner and to push the toner out of said toner reservoir during each revolution of said first paddle;

said first paddle having a first toner moving element for engaging only the toner in said first portion of said toner reservoir;

said toner reservoir having a third portion adjacent said second portion and remote from said first portion;

said first paddle having a second toner moving element for engaging only the toner in said third portion of said toner reservoir during each revolution of said first paddle about the fixed first axis;

and said toner moving element of said second paddle also simultaneously moving through said third portion of said toner reservoir in response to each revolution of said first paddle through said toner reservoir to engage the toner in said third portion of said toner reservoir to agitate the toner and to push the toner out of said toner reservoir during each revolution of said first paddle.

11. The toner cartridge according to claim 10 in which said toner moving element of said second paddle has a substantially sharp end edge for initially engaging the toner in each of said second and third portions of said toner reservoir to agitate the toner.

12. The toner cartridge according to claim 11 in which said toner moving element of said second paddle has a toner engaging surface extending from said substantially sharp end edge of said second paddle to engage the toner in each of said second and third portions of said toner reservoir after said substantially sharp end edge has engaged the toner in each of said second and third portions of said toner reservoir.

13. The toner cartridge according to claim 12 in which said toner moving element of said second paddle has a tear drop shape defining said substantially sharp end edge and said toner engaging surface.

14. The toner cartridge according to claim 13 including means for insuring that said second paddle trails said first paddle during each revolution of said first paddle through said toner reservoir.

15. The toner cartridge according to claim 12 including means for insuring that said second paddle trails said first paddle during each revolution of said first paddle through said toner reservoir.

16. The toner cartridge according to claim 11 including means for insuring that said second paddle trails said first paddle during each revolution of said first paddle through said toner reservoir.

17. The toner cartridge according to claim 10 including means for insuring that said second paddle trails said first paddle during each revolution of said first paddle through said toner reservoir.

18. A toner cartridge comprising:

a toner reservoir having toner therein;

said toner reservoir including a plurality of walls;

said plurality of walls including:

a pair of substantially parallel end walls;

and a longitudinal wall extending between said end walls and joined to each of said end walls;

each of said end walls having a circular shape of the same radius;

said longitudinal wall including:

a first portion having a curved shape extending longitudinally from one of said end walls toward the other of said end walls, said curved shape of said first portion having the same radius as the circular shape of each of said end walls but terminating prior to completion of the circular shape of each of said end walls;

a second portion extending from said first portion toward the other of said end walls;

and a third portion extending from said second portion to the other of said end walls;

said first portion of said longitudinal wall having a substantially greater length than said second portion of said longitudinal wall;

said second portion of said longitudinal wall having a substantially greater length than said third portion of said longitudinal wall;

a first paddle rotatable in said toner reservoir about a fixed first axis, said first paddle being rotatably supported by said end walls;

said first paddle having a clearance from each of said end walls and said longitudinal wall during rotation of said first paddle through said toner reservoir;

a second paddle pivotally supported on said first paddle for pivotal movement about a second axis substantially parallel to the fixed first axis in response to rotation of said first paddle about the fixed first axis;

each of said second portion and said third portion of said longitudinal wall including:

a curved portion having the same shape as said curved shape of said first portion of said longitudinal wall but of less circumference;

and a non-curved portion closer to the fixed first axis than said curved portion of each of said second portion and said third portion of said longitudinal wall;

said curved portion of each of said second portion and said third portion of said longitudinal wall having the same radius as the circular shape of each of said end walls;

said longitudinal wall having an exit port formed therein;

said second paddle having a toner moving element for moving through said toner reservoir having said second and third portions of said longitudinal wall, said toner moving element of said second paddle engaging said second and third portions of said longitudinal wall of said toner reservoir to engage the toner therein to agitate and push the toner out of said toner reservoir through said exit port;

and said first paddle having a first toner moving element for engaging the toner in said toner reservoir along said first portion of said longitudinal wall of said toner reservoir during each revolution of said first paddle to agitate and push the toner out of said toner reservoir through said exit port.

19. The toner cartridge according to claim 18 including said first paddle having a second toner moving element for engaging the toner in said toner reservoir along said third portion of said longitudinal wall of said toner reservoir during each revolution of said first paddle to agitate and push the toner out of said toner reservoir through said exit port.

20. The toner cartridge according to claim 19 in which said first paddle includes:

a shaft rotatably supported in each of said end walls of said toner reservoir;

a plurality of substantially parallel support struts supporting said first toner moving element of said first paddle on said shaft;

and an additional support strut shorter than each of said plurality of support struts supporting said second toner moving element of said first paddle.

21. The toner cartridge according to claim 20 in which:

said first paddle includes a pivot support extending between said additional support strut and said strut of said plurality of struts adjacent said second paddle;

and said second paddle includes:

a pair of substantially parallel support arms pivotally mounted on said pivot support of said first paddle;

an outer toner moving bar supported by said support arms and extending beyond said support arm closest to the adjacent of said end walls of said toner reservoir and constituting said toner moving element of said second paddle;

and a stop pin supported by said support arms closer to said pivot support than said outer toner moving bar and extending beyond the side of each of said support arms for engaging said additional support strut and the adjacent of said plurality of support struts of said first paddle to control when said second paddle flips into engagement with said second portion and said third portion of said longitudinal wall during each revolution of said first paddle through said toner reservoir.

22. The toner cartridge according to claim 18 in which said toner moving element of said second paddle has a substantially sharp end edge for initially engaging the toner in said second portion of said toner reservoir to agitate the toner.

23. The toner cartridge according to claim 22 in which said toner moving element of said second paddle has a toner engaging surface extending from said substantially sharp end edge of said second paddle to engage the toner in said toner reservoir after said substantially sharp end edge has engaged the toner in said toner reservoir and to push the toner out of said toner reservoir.

24. The toner cartridge according to claim 23 in which said toner moving element of said second paddle has a tear drop cross section defining said substantially sharp end edge and said toner engaging surface.

25. The toner cartridge according to claim 24 including means for insuring that said second paddle trails said first paddle during each revolution of said first paddle through said toner reservoir.

26. The toner cartridge according to claim 18 including means for insuring that said second paddle trails said first paddle during each revolution of said first paddle through said toner reservoir.

27. The toner cartridge according to claim 18 in which said second paddle continues to agitate the toner and push the toner out of said toner reservoir after said first paddle ceases to be effective during a revolution of said first paddle.

28. An auxiliary paddle for use in a toner reservoir of a toner cartridge of a laser printer in cooperation with a main paddle revolving in the toner reservoir to aid in removing toner from a portion of the toner reservoir that the main paddle cannot remove the toner including:

a pair of substantially parallel support arms for pivotal support by the main paddle for pivotal movement relative to the main paddle during each revolution of the main paddle;

an outer toner moving bar for engaging the toner to be moved out of the toner reservoir;

said outer toner moving bar being supported by said support arms and extending beyond an outer side of one of said support arms to sweep a volume greater than the volume swept by the portion of said outer toner moving bar between said support arms;

and a stop pin supported by said support arms and extending beyond an outer side of each of said support arms for engaging the main paddle to control when said auxiliary paddle begins sweeping the volume in the toner reservoir during each revolution of the main paddle through the toner reservoir.

* * * * *